US008341962B2

(12) United States Patent
Smith

(10) Patent No.: US 8,341,962 B2
(45) Date of Patent: Jan. 1, 2013

(54) BIASING WORKING FLUID FLOW

(75) Inventor: Raub Warfield Smith, Ballston Lake, NY (US)

(73) Assignee: General Electric Company, Schenectady, NY (US)

( * ) Notice: Subject to any disclaimer, the term of this patent is extended or adjusted under 35 U.S.C. 154(b) by 879 days.

(21) Appl. No.: 12/464,497

(22) Filed: May 12, 2009

(65) Prior Publication Data

US 2010/0287935 A1 Nov. 18, 2010

(51) Int. Cl.
*F01K 7/34* (2006.01)
*F01K 13/00* (2006.01)

(52) U.S. Cl. ..... 60/653; 60/677

(58) Field of Classification Search ..... 60/653, 60/677–679

See application file for complete search history.

(56) References Cited

U.S. PATENT DOCUMENTS 3,300,974 A * 1/1967 Reed et al. ..... 60/677
3,898,842 A * 8/1975 Luongo ..... 60/653
3,973,404 A 8/1976 Iizuka et al.
4,149,386 A * 4/1979 Luongo et al. ..... 60/663
4,353,217 A 10/1982 Nishioka et al.
4,366,675 A 1/1983 Nishioka
5,749,228 A * 5/1998 Shiga et al. ..... 60/679
7,032,384 B2 * 4/2006 Kumagai et al. ..... 60/670
7,607,304 B2 * 10/2009 Kjær ..... 60/653

FOREIGN PATENT DOCUMENTS

JP 409041906 A * 7/1995

* cited by examiner

*Primary Examiner* — Hoang Nguyen
(74) *Attorney, Agent, or Firm* — Hoffman Warnick LLC; Ernest G. Cusick

(57) ABSTRACT

A system and methods are disclosed that assist in biasing of a working fluid. In one embodiment, the method includes providing a first portion of a working fluid to a first low pressure turbine and a second portion of the working fluid to a second low pressure turbine, the second portion being greater in quantity than the first portion; processing the first portion of the working fluid in the first low pressure turbine to create a first exhaust fluid and processing the second portion of the working fluid in the second low pressure turbine to create a second exhaust fluid; providing the first exhaust fluid to a first condenser; and providing the second exhaust fluid to a second condenser, wherein the second exhaust fluid is greater in quantity than the first exhaust fluid.

19 Claims, 7 Drawing Sheets

BIASING WORKING FLUID FLOW

BACKGROUND OF THE INVENTION

The subject matter disclosed herein relates to a method and system for biasing working fluid flow. More specifically, the subject matter herein relates to biasing steam flow to multiple condensing steam turbine sections.

Many smaller or medium sized thermal power plants are designed to supply each steam turbine condenser with coolant (water or air) directly from a coolant source (i.e., cooling tower, lake, ambient air, or river). However, some larger thermal power plants, such as those with four or more low pressure (LP) turbine expansions, are designed differently. In these larger plants, coolant is supplied to a first condenser connected to the first LP turbine, and then reused at its warmer state to cool a second condenser connected to the second LP turbine. After leaving the second condenser, the exhaust heat can be rejected to the ambient. This design may reduce coolant flow, thereby requiring less pump and/or fan power, and may reduce the average condensation pressure. Further, this design may reduce the size of required heat rejection equipment (i.e., cooling tower, air condenser, etc.) by increasing the heat rejection temperature.

While the above-described system may provide better performance than a design with direct coolant supply to each condenser, it still suffers from shortcomings. For example, where both the first LP turbine and the second LP turbine have the same exit annulus area, performance of the system may be less than optimal. In this case, the first LP turbine (receiving lower temperature coolant) will have a lower condenser pressure than the second LP turbine (receiving warmer coolant heated by exhaust from first LP turbine). These differences in condenser pressure lead to a higher exhaust velocity and greater exhaust loss at the first LP turbine, despite the fact that both the first LP turbine and the second LP turbine receive the same amount of steam flow. This may lead to compromised performance of the power plant.

BRIEF DESCRIPTION OF THE INVENTION

A system and methods are disclosed that enable biasing of a working fluid. In one embodiment, the method includes providing a first portion of a working fluid to a first low pressure turbine and a second portion of the working fluid to a second low pressure turbine, the second portion being greater in quantity than the first portion; processing the first portion of the working fluid in the first low pressure turbine to create a first exhaust fluid and processing the second portion of the working fluid in the second low pressure turbine to create a second exhaust fluid; providing the first exhaust fluid to a first condenser; and providing the second exhaust fluid to a second condenser, wherein the second exhaust fluid is greater in quantity than the first exhaust fluid.

A first aspect of the invention provides a method comprising: providing a first portion of a working fluid to a first low pressure turbine and a second portion of the working fluid to a second low pressure turbine, the second portion being greater in quantity than the first portion; processing the first portion of the working fluid in the first low pressure turbine to create a first exhaust fluid and processing the second portion of the working fluid in the second low pressure turbine to create a second exhaust fluid; providing the first exhaust fluid to a first condenser; and providing the second exhaust fluid to a second condenser, wherein the second exhaust fluid is greater in quantity than the first exhaust fluid.

A second aspect of the invention provides a system comprising: an admission line for directing a working fluid flow equally to a first steam turbine and a second steam turbine; the first steam turbine operably connected to the admission line; the second steam turbine operably connected to the admission line; a first extractor operably connected to the first steam turbine for extracting a portion of the working fluid from the first steam turbine; a first condenser having a first condenser coolant discharge, the first condenser operably connected to the first steam turbine exhaust; and a second condenser operably connected to the second steam turbine exhaust and the first condenser coolant discharge.

A third aspect of the invention provides a method comprising: providing a first portion of a working fluid to a first low pressure turbine and a second portion of the working fluid to a second low pressure turbine; processing the first portion of the working fluid in the first low pressure turbine to create a first exhaust fluid and processing the second portion of the working fluid in the second low pressure turbine to create a second exhaust fluid; providing the first exhaust fluid to a first condenser; and providing the second exhaust fluid to a second condenser, wherein the second exhaust fluid is greater in quantity than the first exhaust fluid.

A fourth aspect of the invention provides a system comprising: an admission line for directing a working fluid flow equally between a first steam turbine and a second steam turbine; the first steam turbine operably connected to the admission line; the second steam turbine operably connected to the admission line; a low pressure admission operably connected to the second steam turbine for admitting additional working fluid to the second steam turbine; a first condenser having a first condenser coolant discharge, the first condenser operably connected to a first steam turbine exhaust; and a second condenser operably connected to a second steam turbine exhaust and the first condenser coolant discharge.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

It is noted that the drawings of the invention are not to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As indicated above, aspects of the invention provide a system and methods that enable biasing of working fluid flow. As used herein, the term "biasing" may include dividing a working fluid into portions, and providing more of the working fluid to one portion than to a different portion. The term "working fluid" may refer to any fluid capable of performing functions described herein.

Figure 1:
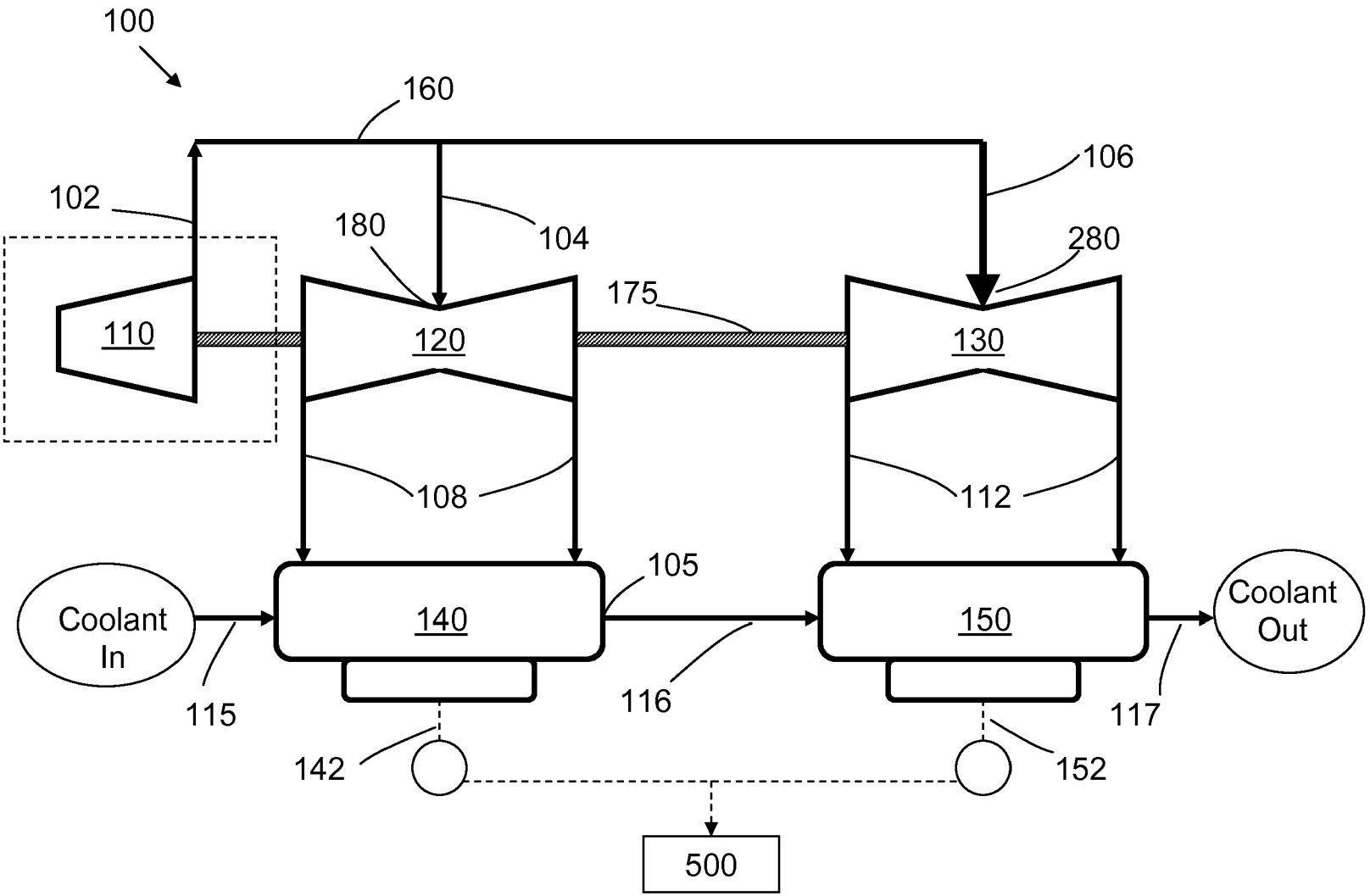
FIG. 1 shows a schematic block diagram illustrating embodiments of a system for biasing working fluid.

Turning to the drawings, FIG. 1 shows a low pressure steam turbine system 100 which may be part of a larger steam turbine system (not shown). Intermediate pressure turbine 110 is shown in FIG. 1 (in phantom box), however, intermediate pressure turbine 110 may act primarily as an input to low pressure steam turbine system 100. Low pressure steam turbine system 100 may include an admission line 160, a first steam turbine 120 operably connected to admission line 160, and a second steam turbine 130 operably connected to admission line 160. Further, low pressure steam turbine system 100 may include a first condenser 140 having a first condenser coolant discharge 105, first condenser 140 being operably connected to first steam turbine 120. Low pressure steam turbine system 100 may also include a second condenser 150 operably connected to second steam turbine 130 and first condenser 140 via, for example, a coolant line (first condenser coolant fluid stream 116). First steam turbine 120 may have an inlet area 180 and second steam turbine 130 may have an inlet area 280. Additionally, first steam turbine 120 and second steam turbine 130 may be coupled via shaft 175.

In FIG. 1, a working fluid 102 is provided to low pressure steam turbine system 100. Working fluid 102 may be, for example, exhaust from intermediate pressure turbine 110. Working fluid 102 flows to admission line 160, which may divide flow of working fluid 102 into a first portion 104 and a second portion 106. In one embodiment, inlet area 280 is larger than inlet area 180. A larger inlet area 280 causes a greater quantity of working fluid 102 to flow toward inlet area 280. This causes second portion 106 to be greater in quantity than first portion 104. Further, this causes second steam turbine 130 to receive a greater quantity of working fluid 102 than first steam turbine 120.

After admission line 160 divides working fluid 102 into first portion 104 and second portion 106, first portion 104 may flow to first steam turbine 120 while second portion 106 may flow to second steam turbine 130. First steam turbine 120 and second steam turbine 130 may process first portion 104 and second portion 106, respectively, in any conventional manner. For example, first portion 104 may expand within first steam turbine 120, applying pressure to turbine blades (not shown), thereby causing those blades to rotate and perform mechanical work. Similarly, second steam turbine 130 may allow for expansion, rotation and production of work using second portion 106. Work performed by first steam turbine 120 and second steam turbine 130 may be coupled by shaft 175 and provided to, for example, a generator (not shown).

After processing in first steam turbine 120 and second steam turbine 130, working fluid 102 may exit first steam turbine 120 as a first exhaust fluid 108, and exit second steam turbine 130 as second exhaust fluid 112. As second portion 106 is greater in quantity than first portion 104, so too is second exhaust fluid 112 greater in quantity than first exhaust fluid 108. First exhaust fluid 108 may flow from first steam turbine 120 to first condenser 140. Similarly, second exhaust fluid 112 may flow from second steam turbine 130 to second condenser 150.

First condenser 140 may condense first exhaust fluid 108 (gas) into a liquid form. First condenser 140 may be, for example, a conventional surface condenser. First condenser 140 may also use a coolant to exchange heat with first exhaust fluid 108, thereby condensing first exhaust fluid 108 and creating first condenser exhaust fluid (condensate) 142. First condenser exhaust fluid 142 may then flow to a boiler 500. Coolant 115 may be a fluid, and may, for example, be water. Coolant may be supplied from, for example, a cooling tower, or from ambient air. After flow through first condenser 140, coolant 115 increases in temperature and forms a first condenser coolant fluid stream 116. First condenser coolant fluid stream 116 may exit first condenser 140 through first condenser coolant discharge 105, and flow to second condenser 150, which may condense second exhaust fluid 112. This may create second condenser exhaust fluid (condensate) 152, which may then flow to boiler 500. After first condenser coolant fluid stream 116 flows through second condenser 150, its temperature will rise, and it may be sent as a second condenser exit coolant 117 to, for example, a cooling tower.

In prior art systems (without larger inlet area 280), first condenser 140 operates at a lower pressure than second condenser 150 because coolant 115 supplied to first condenser 140 is at a lower temperature (i.e., from a heat sink) than first condenser coolant fluid stream 116. This disparity in operating pressure between first condenser 140 and second condenser 150 causes a higher specific volume for first exhaust fluid 108 than for second exhaust fluid 112. However, where exhaust areas of first steam turbine 120 and second steam turbine 130 are identical, the velocity of first exhaust fluid 108 will be greater than the velocity of second exhaust fluid 112 (which has a higher density). This prior art design results in first turbine 120 operating at a higher exhaust velocity than second turbine 130, negatively affecting performance. Low pressure steam turbine system 100, shown and described with reference to FIG. 1, may allow for a reduction in the disparity between exhaust velocities of first turbine 120 and second turbine 130 through biasing the flow of working fluid 102. This system may further provide a greater quantity of second exhaust 112 to second condenser 150 than first exhaust 108 to first condenser 140, allowing for reduced exhaust loss in first condenser 140 and thereby improving the overall efficiency of low pressure steam turbine system 100. Reduced exhaust loss will be further described herein with reference to FIGS. 2-3.

Figure 2:
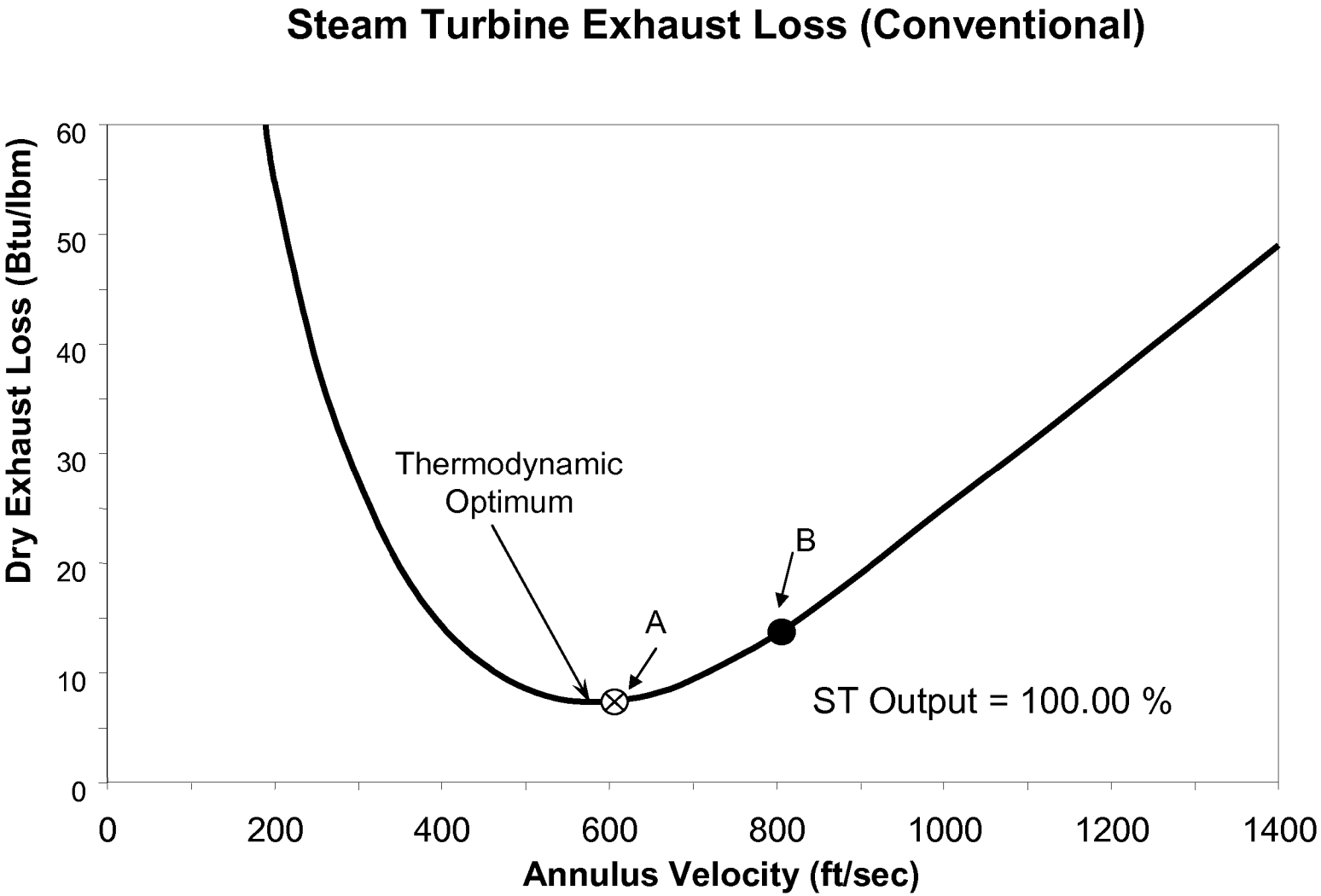
(PRIOR ART) FIG. 2
FIG. 2 shows a data graph illustrating results achieved using prior art systems.
Figure 3:
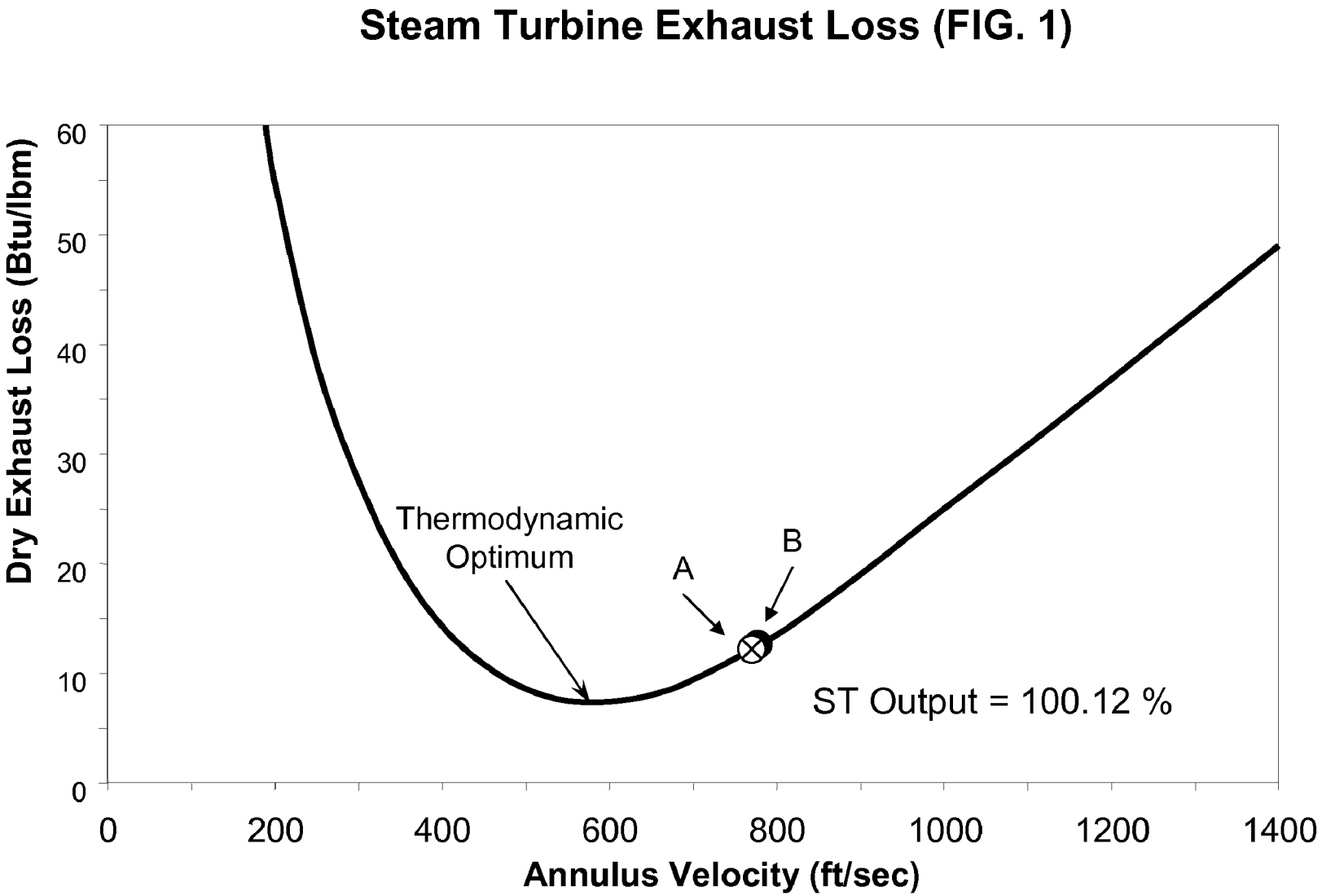
FIG. 3 shows a data graph illustrating results achieved using embodiments of FIGS. 1 and 4-7.

FIG. 2 and FIG. 3 illustrate the improvement in efficiency of low pressure steam turbine system 100 using the method described herein. FIG. 2 shows exhaust loss in a conventional low pressure steam turbine 100 with equal flow of working fluid 102 to first steam turbine 120 and second steam turbine 130. Point "A" represents dry exhaust loss and annulus velocity of first condenser 140 (FIG. 1), while point "B" represents dry exhaust loss and annulus velocity of second condenser 150 (FIG. 1). Further, FIG. 2 shows a scaled steam turbine output at 100.00% under a conventional system utilizing equal flow of working fluid 102 between steam turbines and condensers, respectively. As is shown in FIG. 2, points A and B have different dry exhaust losses and different annulus velocities. Turning to FIG. 3, a graphical representation of exhaust loss in low pressure steam turbine system 100 including admission line 160 and biased flow of working fluid 102 is shown. As shown, points A and B are at substantially similar locations on the dry exhaust loss curve. As compared with FIG. 2, the dry exhaust loss of first condenser 140 has decreased along with its annulus velocity. However, the dry exhaust loss of second condenser 150 has increased along with its annulus velocity. The decreased exhaust loss of first condenser 140 outweighs the increase in dry exhaust loss of second condenser 150, thereby increasing overall steam turbine output. FIG. 3 shows a scaled steam turbine output under the embodiments shown in FIG. 1 at 100.12%.

Figure 4:
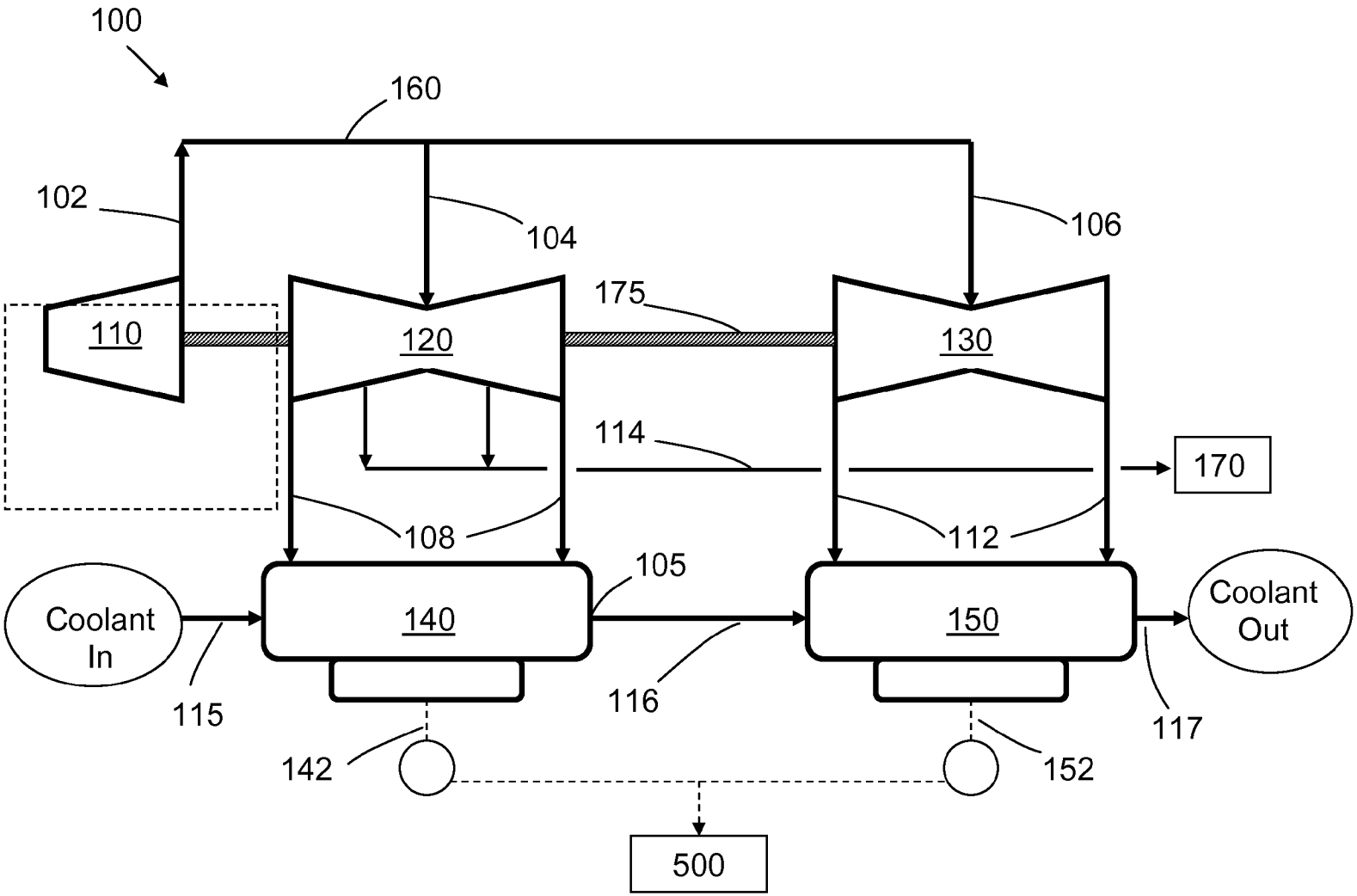
FIGS. 4-7 show schematic block diagrams illustrating further embodiments of a system for biasing working fluid.

FIG. 4 shows an alternative embodiment in which first portion 104 and second portion 106 of working fluid 102 are substantially equal. This in turn provides first steam turbine 120 and second steam turbine 130 with equal amounts of working fluid 102. In this embodiment, low pressure steam turbine system 100 may include a first extractor 170 operably connected to first steam turbine 120. Extractor 170 may extract a portion 114 of first portion 104 during processing (expansion in first steam turbine 120) and before providing of first exhaust fluid 108 to first condenser 140. Extractor 170 may, for example, extract portion 114 for use in a heat exchanger in other parts of the larger steam turbine system (not shown). In any event, extractor 170 serves to increase the disparity in quantity between first exhaust fluid 108 and second exhaust fluid 112 provided to first condenser 140 and second condenser 150, respectively. While a single extractor 170 is shown, it is understood that multiple extractors may be used to extract multiple portions 114 at different stages of processing within first steam turbine 120. In contrast to systems which uniformly extract the same steam flow from first steam turbine 120 and second steam turbine 130, the preferential extraction of portion 114 from steam turbine 120 in this embodiment may provide an increase in overall steam turbine output and efficiency. The embodiment of FIG. 4 may have a substantially similar increase in overall steam turbine efficiency as the embodiments described with reference to FIG. 3.

Figure 5:
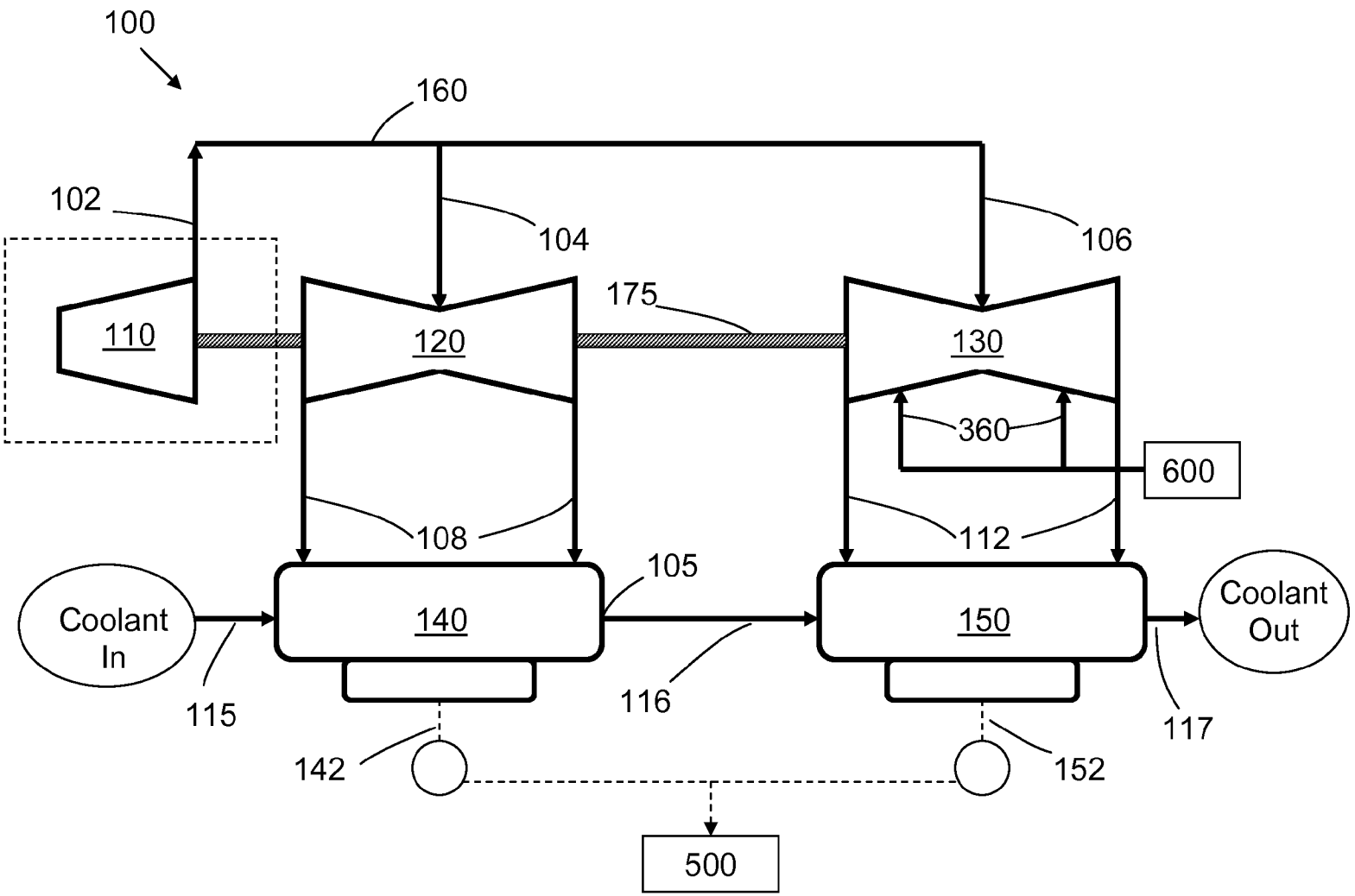

FIG. 5 shows another alternative embodiment using low pressure admission 360 during part of expansion of working fluid 102 within second steam turbine 130. This embodiment may be used in combined cycle systems, whereby waste heat from a gas turbine generator 600 is used to create low pressure steam which may be supplied as low pressure admission 360 to second steam turbine 130. In this case, first portion 104 and second portion 106 of working fluid 102 may be of substantially equal quantities, but low pressure admission 360 may provide for an increase in quantity of second exhaust fluid 112 from second steam turbine 130. In comparison to systems using equal flow of low pressure admission 360 to first low pressure steam turbine 120 and second low pressure steam turbine 130, the embodiment of FIG. 5 may provide increases in overall steam turbine efficiency and output. The embodiment of FIG. 5 may provide substantially similar increases as those embodiments described with reference to FIG. 3.

Figure 6:
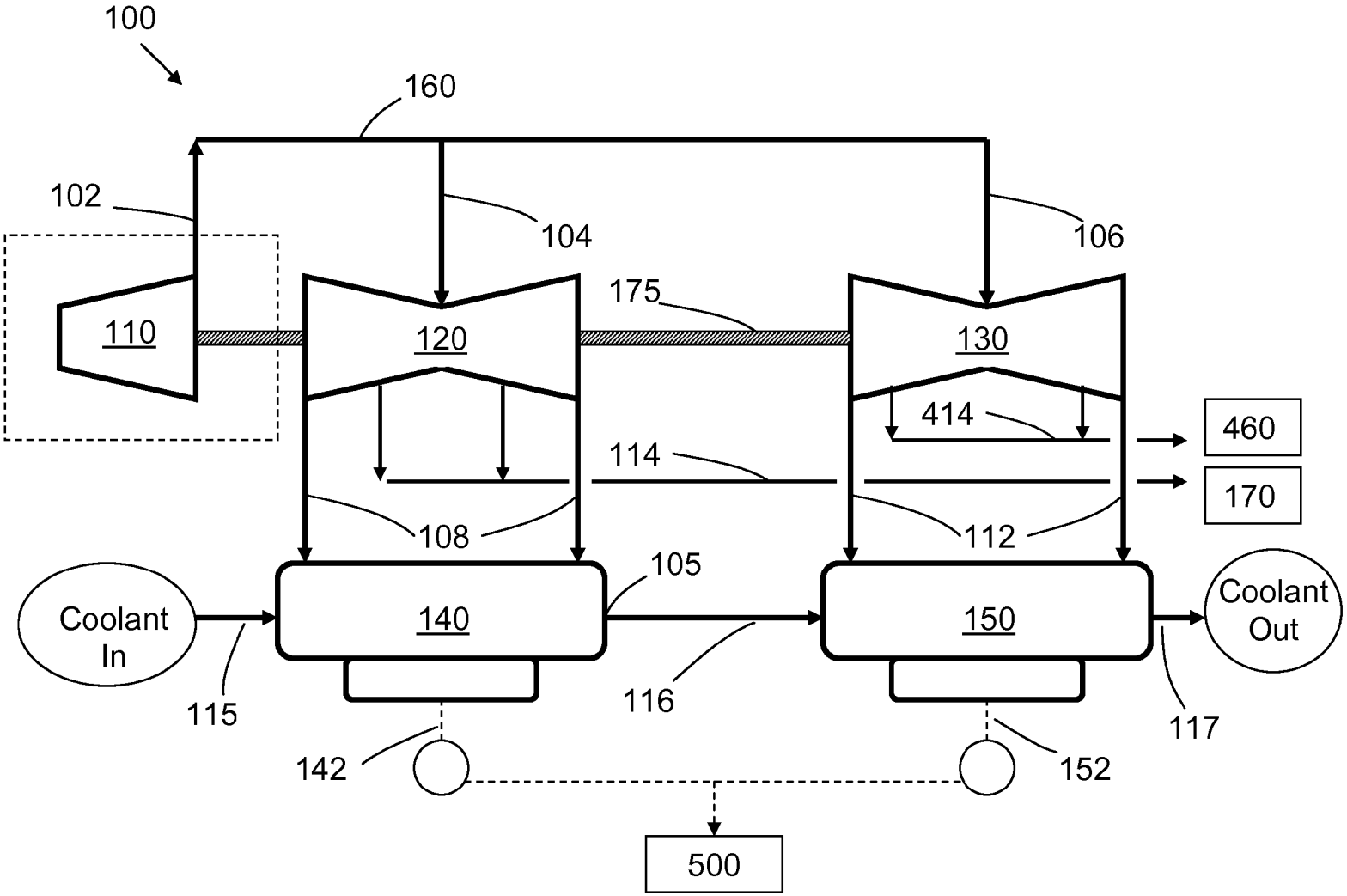

FIG. 6 shows another alternative embodiment using unequal extractions from first steam turbine 120 and second steam turbine 130 before condensing of first exhaust 108 and second exhaust 112. In this case, extractor 170 removes a portion 114 of first portion 104, as described with reference to FIG. 4. However, additional extractor 460 may also remove a portion 414 of second portion 106 from second steam turbine 130. Additional extractor 460 may remove portion 414 of second portion 106 in a similar fashion to extractor 170. While first portion 104 and second portion 106 of working fluid 102 may be of substantially equal quantities, extractor 170 and additional extractor 460 may provide unequal quantities of first exhaust 108 and second exhaust 112 to first condenser 140 and second condenser 150, respectively. In this case, extracted portion 414 may be smaller in quantity than extracted portion 114. The embodiment of FIG. 6 may provide a substantially similar increase in overall steam turbine efficiency and output as the embodiments described with reference to FIG. 3.

Figure 7:
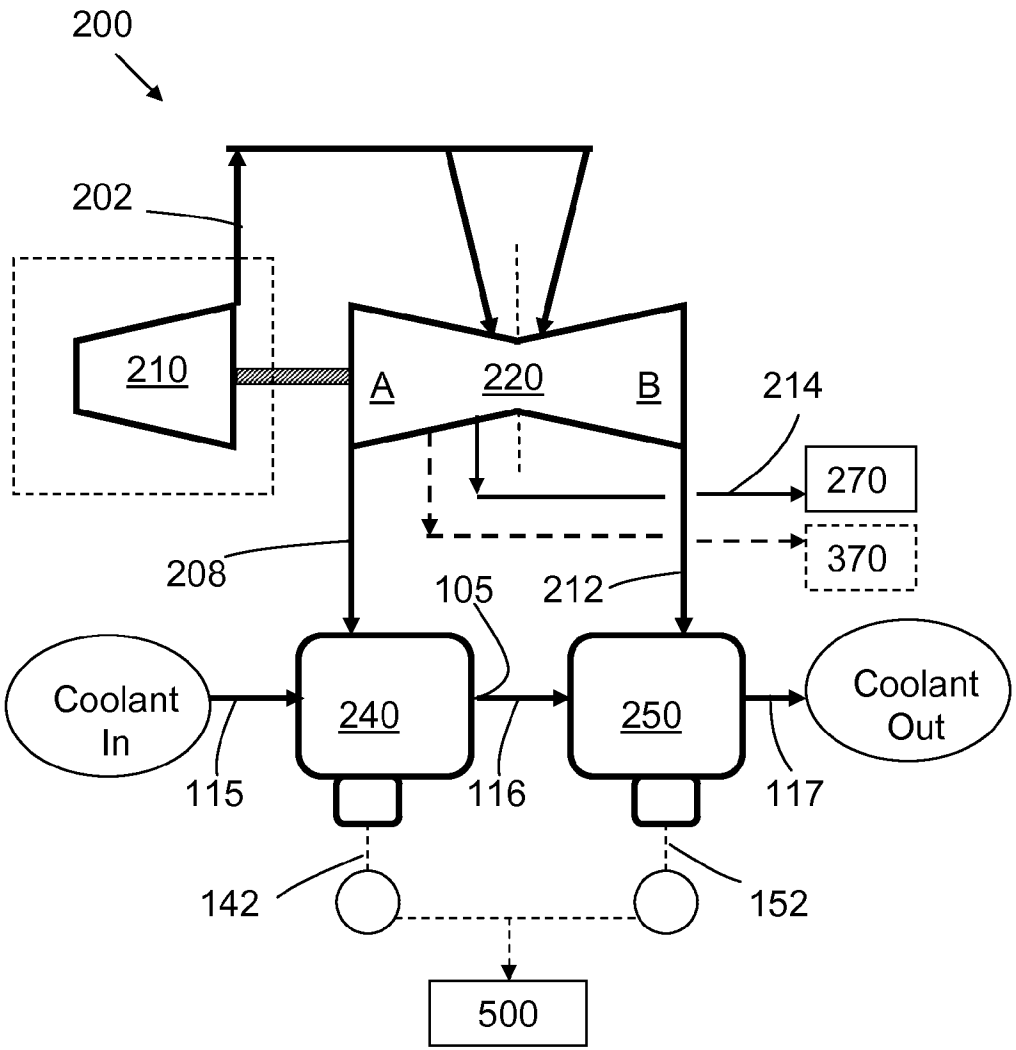

FIG. 7 shows another alternate embodiment of biasing working fluid flow using a two-flow steam turbine 220 in low pressure steam turbine system 200. Low pressure steam turbine system 200 may include an intermediate pressure turbine 210, a two-flow steam turbine 220, a first condenser 240 and a second condenser 250. Further, low pressure steam turbine system 200 may also include one or more extractors 270, 370 (additional extractor shown in phantom). Working fluid 202 may be processed by two-flow steam turbine 220, producing turbine exhaust 208 and turbine exhaust 212. In this case a single two-flow steam turbine 220 may replace first steam turbine 120 and second steam turbine 130 (FIG. 1). Two-flow steam turbine 220 may have multiple inputs (not shown), allowing for working fluid 202 to enter side "A" and side "B" separately. As shown in FIG. 7, sides A and B may be separate chambers within two-flow steam turbine 220, and may have separate inputs and outputs (separation shown in phantom). Similarly to embodiments shown in FIGS. 1 and 4-6, a greater quantity of working fluid 202 may be provided to second condenser 250 (via turbine exhaust 212) than to first condenser 240 (via turbine exhaust 208). For example, extractor 270 may extract a portion 214 of working fluid 202 from side A to provide a greater quantity of working fluid 202 to second condenser 250 (side B) than to first condenser 240 (side A), as described with reference to FIG. 1. Further, a low pressure admission may be added to side B of two-flow steam turbine 220 as described with reference to FIG. 5. In any case, the increase in overall steam turbine efficiency and output using this embodiment may be substantially similar to that discussed with reference to FIG. 3.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method comprising:

providing a first portion of a working fluid to a first low pressure turbine and a second portion of the working fluid to a second low pressure turbine, the second portion being greater in quantity than the first portion;

processing the first portion of the working fluid in the first low pressure turbine to create a first exhaust fluid and processing the second portion of the working fluid in the second low pressure turbine to create a second exhaust fluid;

providing the first exhaust fluid to a first condenser; and providing the second exhaust fluid to a second condenser, wherein the second exhaust fluid is greater in quantity than the first exhaust fluid, and the quantity of the first exhaust fluid and the quantity of the second exhaust fluid are greater than zero.

2. The method of claim 1, further comprising admitting a second working fluid to the second steam turbine using a low pressure admission line.

3. The method of claim 2, further comprising modifying a quantity of the second portion of the working fluid and a quantity of the first portion of the working fluid.

4. The method of claim 1, further comprising extracting a portion of the first exhaust fluid during the processing of the first portion of the working fluid and before the providing of the first exhaust fluid to a first condenser.

5. The method of claim 4, further comprising modifying a quantity of the portion of the first exhaust fluid.

6. The method according to claim 1, further comprising:

providing a third portion of the working fluid to a third low pressure turbine;

processing the third portion of the working fluid in the third low pressure turbine to create a third exhaust fluid; and providing the third exhaust fluid to a third condenser, wherein the third exhaust fluid is greater in quantity than the second exhaust fluid.

7. A system comprising:

an admission line for directing a working fluid flow to a first steam turbine and a second steam turbine;

the first steam turbine operably connected to the admission line;

the second steam turbine operably connected to the admission line, wherein the first steam turbine has a first inlet area and the second steam turbine has a second inlet area, the second inlet area being larger than the first inlet area, wherein the admission line provides a greater quantity of the working fluid to the second steam turbine than to the first steam turbine;

a first extractor operably connected to the first steam turbine for extracting a portion of the working fluid from the first steam turbine;

a first condenser having a first condenser coolant discharge, the first condenser operably connected to the first steam turbine exhaust; and a second condenser operably connected to the second steam turbine exhaust and the first condenser.

8. The system of claim 7, further comprising:

a third steam turbine operably connected to the admission line; and a third condenser operably connected to the third steam turbine and the second condenser.

9. The system of claim 8, wherein the admission line provides a greater quantity of the working fluid to the third steam turbine than to the second steam turbine.

10. The system of claim 7, further comprising a second extractor operably connected to the second steam turbine for extracting a second portion of the working fluid from the second steam turbine.

11. The system of claim 7, further comprising a low pressure admission line connected to the second steam turbine for admitting a second working fluid to the second steam turbine.

12. The system of claim 7, wherein the second condenser receives a first condenser coolant fluid stream from the first condenser and a second exhaust fluid from the second steam turbine.

13. The system of claim 7, further comprising a second extractor operably connected to the first steam turbine for extracting a second portion of the working fluid from the first steam turbine.

14. The system of claim 7, wherein the first steam turbine has a first inlet area and the second steam turbine has a second inlet area, the second inlet area being larger than the first inlet area.

15. The system of claim 14, wherein the first inlet area and the second inlet area are operably connected to the admission line.

16. A method comprising:

providing a first portion of a working fluid to a first low pressure turbine and a second portion of the working fluid to a second low pressure turbine, wherein the first portion of the working fluid and the second portion of the working fluid are substantially equal in quantity;

processing the first portion of the working fluid in the first low pressure turbine to create a first exhaust fluid and processing the second portion of the working fluid in the second low pressure turbine to create a second exhaust fluid;

providing the first exhaust fluid to a first condenser; and providing the second exhaust fluid to a second condenser, wherein the second exhaust fluid is greater in quantity than the first exhaust fluid.

17. The method of claim 16, wherein the first low pressure turbine has a first inlet area and the second low pressure turbine has a second inlet area, the second inlet area being larger than the first inlet area.

18. The method of claim 16, further comprising modifying the quantity of the second portion of the working fluid and the quantity of the first portion of the working fluid.

19. The method of claim 16, further comprising extracting a portion of the working fluid during the processing of the first portion of the working fluid and before the providing of the first exhaust fluid to a first condenser.

* * * * *